United States Patent [19]

Glaser et al.

[11] Patent Number: 4,691,450

[45] Date of Patent: Sep. 8, 1987

[54] METHOD AND APPARATUS FOR THE REMOVAL OF LIQUID FROM A RUNNING YARN

[75] Inventors: Dieter Glaser, Karl Marx Stadt; Theobald Klemm, Dittersdorf, both of German Democratic Rep.

[73] Assignee: VEB Kombinat Textima, Karl Marx Stadt, German Democratic Rep.

[21] Appl. No.: 788,275

[22] Filed: Oct. 17, 1985

[30] Foreign Application Priority Data

Jan. 7, 1985 [DD] German Democratic Rep. ... 272437

[51] Int. Cl.[4] ..... F26B 3/04

[52] U.S. Cl. ..... 34/23; 34/155; 34/160; 15/306 A; 15/316 R

[58] Field of Search ..... 15/306 A, 316 R; 68/20; 34/155, 160, 23

[56] References Cited

U.S. PATENT DOCUMENTS 4,234,312 11/1980 Paoletti et al. ..... 68/20
4,549,361 10/1985 Brough et al. ..... 34/155

FOREIGN PATENT DOCUMENTS 756808 6/1953 Fed. Rep. of Germany .
1917535 10/1970 Fed. Rep. of Germany .
2431996 2/1975 Fed. Rep. of Germany .

*Primary Examiner*—Larry I. Schwartz
*Attorney, Agent, or Firm*—Jordan and Hamburg

[57] ABSTRACT

Liquid is mechanically removed from a running yarn by an apparatus and method in which the yarn is passed in running contact with the bottom of a channel in a yarn guide while directing a jet of gas into the channel obliquely or perpendicularly to the yarn path through the channel.

13 Claims, 4 Drawing Figures

METHOD AND APPARATUS FOR THE REMOVAL OF LIQUID FROM A RUNNING YARN

BACKGROUND OF THE INVENTION AND RELATED ART STATEMENT

The invention relates to the mechanical removal of a liquid from a running yarn after a liquid treatment.

After a liquid treatment of yarns, for example, during the spinning process of viscose rayon, it is advantageous to mechanically remove as great a portion as possible of the liquid contained in a yarn. This leads to considerable savings in time and energy in the subsequent drying process.

Methods are already known according to which a jet of gas is blown along in the opposite direction of the yarn motion (DE-PS No. 756,808 and DE-OS No. 1,917,535). However, thereby is removed only the liquid which adheres to the surface of the yarn. The effect of water removal is correspondingly small. For example, in the DE-PS No. 756,808 it is indicated that a yarn band made of viscose which, in relationship to its dry mass, contains 185% liquid before water removal, still contains 115% after it. Therefore, approximately 38% of the liquid contained in the yarn has been removed.

In DE-OS No. 2,431,996 is described a nozzle which operates according to the same method. By a special configuration and a tangentially conducted conveyance of the blowing air, there is attained an additional squeezing out of the yarn, and thus an improvement of the effect of water removal. However, the nozzle has a complicated construction and is expensive to manufacture.

All of the above-mentioned solutions have the disadvantage that the jet of gas directed in opposite direction to the yarn motion exerts a force on the yarn which increases the longitudinal tension thereof. In the subsequent processing, especially of wet yarns, which still do not have a high tear strength, this frequently causes the yarn to break. Furthermore, the residual shrinkage value of the finished yarns is unfavorably affected.

Additionally, from the GB Pat. No. 2,009,030 A it is known to apply to a yarn band running over a roller a jet of gas by means of a broad-jet nozzle in the direction opposite to the direction of the yarn motion, tangentially to the surface of the roller. The therein indicated effect of water removal is also unsatisfactory. It amounts to only 50% of the initial moisture content.

Furthermore, it is disadvantageous that the yarns have to run at an increased longitudinal tension in order to prevent them from being blown away to the sides. Thus, the method is not suited for loosely guided yarns. Additionally, there is also a very high air consumption.

The object of the invention is to provide that the liquid contained in a running yarn is to the greatest possible extent removed and reliably carried off by simple means and without increasing the yarn tension.

SUMMARY OF THE INVENTION

According to the invention, there is provided a method for mechanically removing liquid from a running yarn solely by the squeezing action of a jet of gas, comprising passing a wet yarn in running contact with a surface bounded by means for forming the side walls of a channel of which said surface defines the bottom, and directing a jet of gas approximating the width of the channel downwardly into the channel so that it impinges on the yarn and is deflected off the bottom of the channel, the gas surrounding and squeezing the yarn in the channel thereby to squeeze liquid from the yarn. The corresponding apparatus is also provided according to the invention, which apparatus comprises a yarn guide having a channel formed therein of a width greater than the thickness of the yarn and depth greater than the width, means for guiding a running yarn so that it contacts the bottom of the channel and a gas jet sized and oriented for directing a jet of gas approximating the width of the channel downwardly into the channel so that the gas impinges on the yarn and is deflected off the bottom of the channel, the gas surrounding and squeezing the yarn in the channel thereby to squeeze liquid from the yarn.

The invention has the advantage of requiring only a thin jet of gas of which the action is concentrated by obstructing and lateral channeling of it into a course along the yarn. The yarn is surrounded by the gaseous medium and is thereby intensively squeezed out from all sides at the point where the jet is obstructed. The yarn is thereby gliding on a thin layer of the gaseous medium and therefore runs almost without friction through the treatment zone. The jet of gas is diverted along the yarn in the same and in the opposite direction of the yarn motion. The tensioning forces acting on the yarn thereby almost cancel themselves. The portion of the jet directed counter the yarn direction thereby takes care of a reliable carrying off of squeezed-out liquid.

An essential advantage of the method consists in that several individual yarns can be combined and squeezed as if they were a single yarn by only one jet of gas. Thus, there results a considerable reduction of energy use and a reduction of the space requirement and construction costs per yarn.

It is furthermore advantageous that the yarn be diverted away from the jet of gas in front of and/or behind the jet of gas. Thus the distances over which the portions of the jet travel along the yarn become small, and the thereby created tension forces become also small. Furthermore, the yarn path thereby comes stabilized, and occasionally occurring oscillations are eliminated.

A constant increase of the yarn tension due to the tension forces resulting from the treatment is prevented, if, when seen in the direction of the yarn motion, the distance extending from the sharp bend of a deflection before the jet of gas to the jet of gas is smaller than the straight yarn distance following after the jet of gas, and if the jet of gas is inclined to such extent in relation to the direction of the yarn motion, that the two tension forces are equal. Because of the inclination of the jet of gas in relation to the yarn motion, the liquid is thereby safely carried off. This is augmented if the yarn is proceeding towards the treatment area at an inclination.

The apparatus according to the invention essentially consists only of a yarn guide body which has a channel and a nozzle arranged facing the yarn guide body. The apparatus can be manufactured in an uncomplicated, simple way and does not require much space. The usual textile industry yarn guides for weighting can be used without modification as the yarn guide bodies.

BRIEF DESCRIPTION OF THE DRAWINGS

In the following, the invention will be further explained by an example in conjunction with the drawings, in which.

DETAILED DESCRIPTION OF PREFERRED EMBODIMENTS

Figure 1:
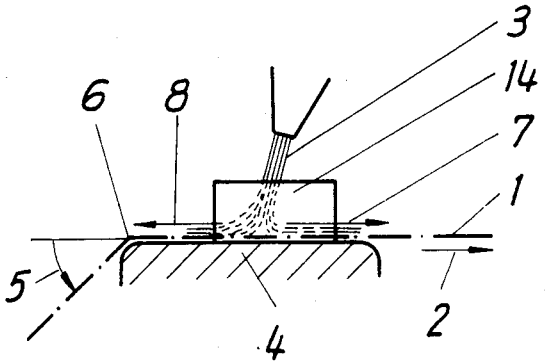
FIG. 1 is a schematic side elevation, partly in cross-section, of apparatus illustrated schematically for the purpose of explaining the principles of the invention.
Figure 2:
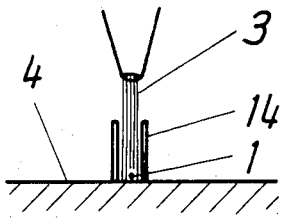
FIG. 2 is a schematic front elevation of the apparatus of FIG. 1.

The FIGS. 1 and 2 show a jet of gas 3 which is inclined in relation to the yarn motion direction 2 and is directed on a yarn 1. By "gas" is thereby to be understood air, steam or another appropriate gaseous medium. The jet of gas 3 is obstructed behind the yarn 1 by a deflection surface 4 and is laterally channeled along the yarn path by the walls 14. The jet of gas 3 is thereby deflected in the same and in the opposite direction of the yarn motion direction 2, whereby the portion directed in the opposite direction to the yarn motion direction 2 is greater because of the inclination of the jet of gas 3. Due to the deflection 5 of the yarn 1, this portion acts upon the yarn 1 only up to its sharp bend 6. The inclination of the jet of gas 3 can be arranged such that the smaller portion, which flows off in the yarn motion direction 2 and acts on a greater length of the yarn 1, creates a tension force 7 which is equal to the tension force 8 which is created by the oppositely directed greater portion of the jet of gas 3 and which is acting upon the shorter yarn length up to the sharp bend 6. In a variation of the embodiment of FIG. 1, it is also possible that the jet of gas 3 impinge perpendicularly upon the yarn 1.

Figure 3:
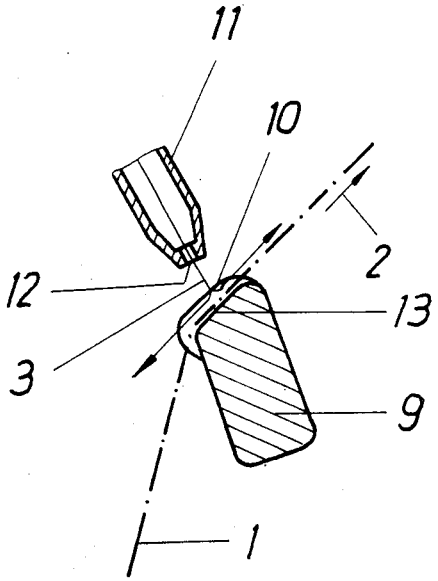
FIG. 3 is a side elevation, partly in cross-section, of apparatus according to the invention.
Figure 4:
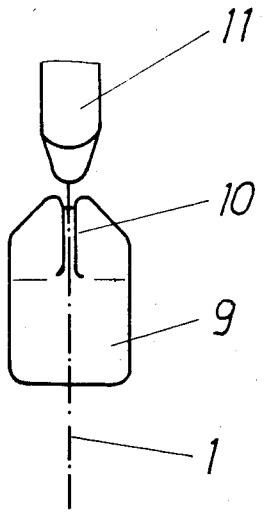
FIG. 4 is a front elevation of the apparatus of FIG. 3.

FIGS. 3 and 4 show an apparatus intended for the execution the method. A yarn guide body 9 having a channel 10 is arranged extending so far into the yarn path that the yarn 1 makes contact with the channel 10 at the base 13 and is deflected from its original path. The yarn guide body 9 thereby assumes such a position that the bend 6 is located at the location where the yarn 1 runs onto the yarn guide body 9 and that the base 13 of the channel 10 is directed to the yarn motion direction 2. A nozzle 11, which is connected to a blower which is not illustrated, having a diameter corresponding approximately to the width of the channel 10, is arranged such that its outlet opening 12 is directed against the yarn guide body 9 and is arranged exactly opposite to the channel 10.

When a jet of gas 3 is directed by means of the nozzle 11 onto the yarn 1, there builds up an air damming zone in the channel 10 having a maximum directly under the jet of gas 3 and decreasing laterally along the yarn. The pressure profile is similar to that which exists when liquids are squeezed out of a yarn or a fabric web by two pressure rollers.

A high squeezing-out effect is attained. For example, from viscose rayon containing 185% water in the wet state, water was removed with pressurized air at 0.1 MPa gauge pressure and a residual moisture content of less than 40% was attained. This means that according to the method of the invention, 78% of the liquid originally contained in the yarn 1 has been removed from the yarn 1.

In addition to the squeezing-out effect, by means of damming up and channeling the jet of gas 3, it is effected that the yarn 1 is lifted off the base 13 of the channel 10. It is floating on a thin layer of the gaseous medium and therefore glides almost without friction through the channel 10.

What we claim is:

1. Method for removing liquid from a running yarn exclusively by the squeezing action of a jet of gas, comprising passing a wet yarn in running contact with a surface bounded by means for forming the side walls of a channel of which said surface defines the bottom, and directing a jet of gas approximating the width of the channel downwardly into the channel so that it impinges on the yarn and is deflected off the bottom of the channel, the gas surrounding and squeezing the yarn in the channel thereby to squeeze liquid from the yarn.

2. Method according to claim 1, further comprising upstream from the channel with respect to the direction of travel of the yarn deflecting the yarn out of the gas stream.

3. Method according to claim 2, further comprising upstream from the channel with respect to the direction of travel of the yarn deflecting the yarn out of the gas stream so that the yarn path in the gas stream upstream from the first impingement of the gas on the yarn is shorter than the yarn path in the gas stream downstream from the first impingement of the gas on the yarn.

4. Method according to claim 3, in which the relative lengths of the yarn paths in the gas streams upstream and downstream from the first impingement of the gas on the yarn are so selected that the tensions on the yarn upstream and downstream from said first impingement are equal.

5. Method according to claim 3, further comprising downstream from the channel with respect to said direction of travel of the yarn deflecting the yarn out of the gas stream.

6. Apparatus for removing liquid from a running yarn exclusively by the squeezing action of a jet of gas, comprising a yarn guide having a channel formed therein of width greater than the thickness of the yarn and depth greater than the width, means for guiding a running yarn so that it contacts the bottom of the channel and a gas jet sized and oriented for directing a jet of gas approximating the width of the channel downwardly into the channel so that the gas impinges on the yarn and is deflected off the bottom of the channel, the gas surrounding and squeezing the yarn in the channel thereby to squeeze liquid from the yarn.

7. Apparatus according to claim 6, further comprising means formed on the yarn guide upstream from the channel with respect to the direction of travel of the yarn for deflecting the yarn out of the gas stream.

8. Apparatus according to claim 7, further comprising means formed on the yarn guide upstream from the channel with respect to the direction of travel of the yarn for deflecting the yarn out of the gas stream so that the yarn path in the gas stream upstream from the first impingement of the gas on the yarn is shorter than the yarn path in the gas stream upstream from the first impingement of the gas on the yarn.

9. Apparatus according to claim 8, further comprising means formed on the yarn guide downstream from the channel with respect to the direction of travel of the yarn for deflecting the yarn out of the gas stream.

10. Method for mechanically removing liquid from a running yarn solely by the squeezing action of a jet of gas, comprising passing a wet yarn in running contact with a surface bounded by means for forming the side walls of a channel of which said surface defines the bottom, and directing a jet of gas approximating the width of the channel downwardly into the channel so that it impinges on the yarn and is deflected off the bottom of the channel, the jet of gas being directed at an acute angle relative to the path of yarn travel downstream from the first impingement of the gas on the yarn so that a greater portion of the gas moves opposite the travel of the yarn than moves with the travel of the yarn, the gas surrounding and squeezing the yarn in the channel thereby to squeeze liquid from the yarn.

11. Method for mechanically removing liquid from a running yarn solely by the squeezing action of a jet of gas, comprising passing a wet yarn in running contact with a surface bounded by means for forming the side walls of a channel of which said surface defines the bottom, and directing a jet of gas approximating the width of the channel downwardly into the channel so that it impinges on the yarn and is deflected off the bottom of the channel, the jet of gas being directed at a right angle relative to the path of yarn travel downstream from the first impingement of the gas on the yarn, the gas surrounding and squeezing the yarn in the channel thereby to squeeze liquid from the yarn.

12. Apparatus for mechanically removing liquid from a running yarn by solely the squeezing action of a jet of gas, comprising a yarn guide having a channel formed therein of width greater than the thickness of the yarn and depth greater than the width, means for guiding a running yarn so that it contacts the bottom of the channel and a gas jet sized and oriented for directing a jet of gas approximating the width of the channel downwardly into the channel so that the gas impinges on the yarn and is deflected off the bottom of the channel, the jet being directed at an acute angle relative to the path of yarn travel downstream from the first impingement of the gas on the yarn, so that a greater portion of the gas moves opposite the travel of the yarn than moves with the travel of the yarn, the gas surrounding and squeezing the yarn in the channel thereby to squeeze liquid from the yarn.

13. Apparatus for mechanically removing liquid from a running yarn by solely the squeezing action of a jet of gas, comprising a yarn guide having a channel formed therein of width greater than the thickness of the yarn and depth greater than the width, means for guiding a running yarn so that it contacts the bottom of the channel and a gas jet sized and oriented for directing a jet of gas approximating the width of the channel downwardly into the channel so that the gas impinges on the yarn and is deflected off the bottom of the channel, the jet being directed at a right angle relative to the path of yarn travel downstream from the first impingement of the gas on the yarn, the gas surrounding and squeezing the yarn in the channel thereby to squeeze liquid from the yarn.

* * * * *